US005092096A

United States Patent [19]

Cornell

[11] Patent Number: 5,092,096

[45] Date of Patent: Mar. 3, 1992

[54] TEMPORARY BRIDGE JOIST SUPPORT BRACKET

[76] Inventor: James C. Cornell, 9501 S. Nogales Ave., Jenks, Okla. 74037

[21] Appl. No.: 626,958

[22] Filed: Dec. 13, 1990

[51] Int. Cl.[5] ..... E04B 1/38

[52] U.S. Cl. ..... 52/702; 403/232.1; 249/211; 248/228

[58] Field of Search ..... 403/232.1; 52/702; 249/211, 219.1, 23; 248/228, 237

[56] References Cited

U.S. PATENT DOCUMENTS

| | | | |
|---|---|---|---|
| 874,514 | 12/1907 | Lindow | 403/232.1 X |
| 2,003,635 | 6/1935 | Markham | 25/131.5 |
| 3,738,602 | 6/1973 | Arnett | 248/228 |
| 3,888,452 | 6/1975 | Anderson | 249/23 |
| 3,954,248 | 5/1976 | Barber | 249/211 |
| 4,124,962 | 11/1978 | Lancelot | 52/702 |
| 4,158,940 | 6/1979 | Lancelot | 52/702 |
| 4,856,252 | 8/1989 | Cornell | 52/702 |

*Primary Examiner*—Andrew V. Kundrat
*Attorney, Agent, or Firm*—Head & Johnson

[57] ABSTRACT

Brackets for suspending a wooden joist at its ends from vertical bolts depending from hangers extending across bridge support columns are formed from rigidly joined side plates, a top plate and a bottom plate. The top plate has a tongue with a vertical hole through it for mounting the brackets on the bolts supported by opposite columns. The ends of the joist are inserted into the suspended brackets to support the joist between the columns. The brackets are relatively lightweight, inexpensive, easy to handle, not readily damaged and eliminate the need for clumsy, breakable and expensive telescoping steeljoists.

13 Claims, 1 Drawing Sheet

TEMPORARY BRIDGE JOIST SUPPORT BRACKET

BACKGROUND OF THE INVENTION

This invention generally concerns construction of bridges consisting of concrete spans extending between columns and more particularly concerns temporary systems used to support poured concrete spans during dying.

The typical support system presently in use employs telescoping steel joists which can be extended or retracted depending upon the distance between columns. The telescoping joists are connected at each end to a suitable hanger assembly mounted on each of the columns. The telescoping joists generally include a locking mechanism to secure the joist at its telescoped length.

These telescoping joints are generally extremely heavy, difficult to manipulate, inconvenient to transport, time consuming in operation, expensive in relation to their purpose and easily rendered inoperable because of their moving parts.

It is therefore among the objects of this invention to provide a device that minimizes or eliminates these and other problems encountered in the assembly and disassembly of temporary supports for poured concrete bridge spans.

SUMMARY OF THE INVENTION

In accordance with the invention a bracket is provided for suspending a joist at its ends from vertical bolts depending from hangers extending across the bridge support columns. A rectangular channel is formed from rigidly joined side plates, a top plate and a bottom plate. The top plate has a tongue portion extending forwardly of the channel with a vertical hole through the tongue. The threaded end of the hanger supported bolt is inserted through the tongue and a nut applied to the threaded end so that the tongue will rest on the nut. With one such bracket mounted on each of the bolts supported by opposite columns, the ends of the joist can be inserted into the rear portions of oppositely suspended brackets to support the joist between the columns. The brackets are relatively lightweight, inexpensive, easy to handle and not readily damaged. By using the brackets, the telescoping steel joists can be replaced with wood joists of appropriate length which are also easy to handle, comparatively inexpensive and without moving parts.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 3:
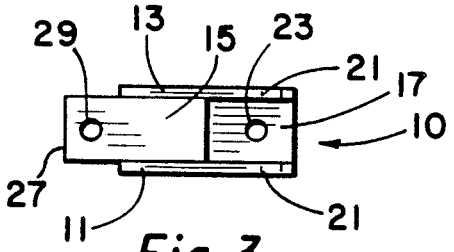
FIG. 3 is a top view of the bracket of FIG. 1.
Figure 1:
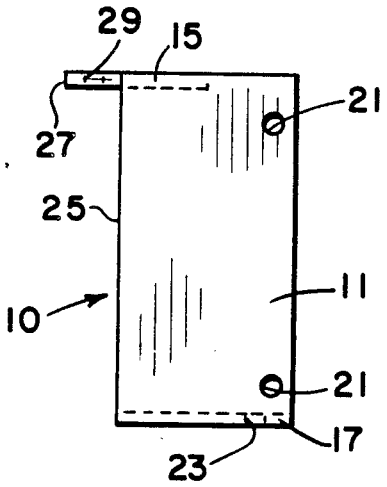
FIG. 1 is a side elevation view of one embodiment of the temporary bridge joist support bracket.
Figure 2:
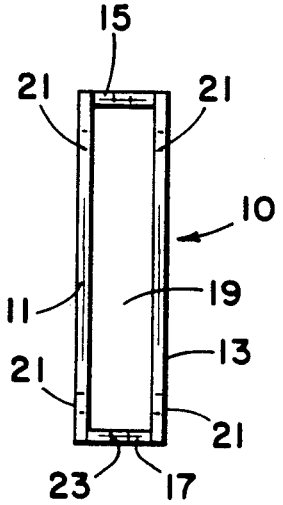
FIG. 2 is a front elevation view of the bracket of FIG. 1.

Turning first to FIGS. 1, 2 and 3, one embodiment of the temporary bridge joist support bracket 10 is illustrated. In this embodiment, the bracket 10 includes a pair of vertical side plates 11 and 13 spaced apart by a horizontal top plate 15 and a horizontal bottom plate 17 to form a rectangular channel 19 therebetween.

Figure 5:
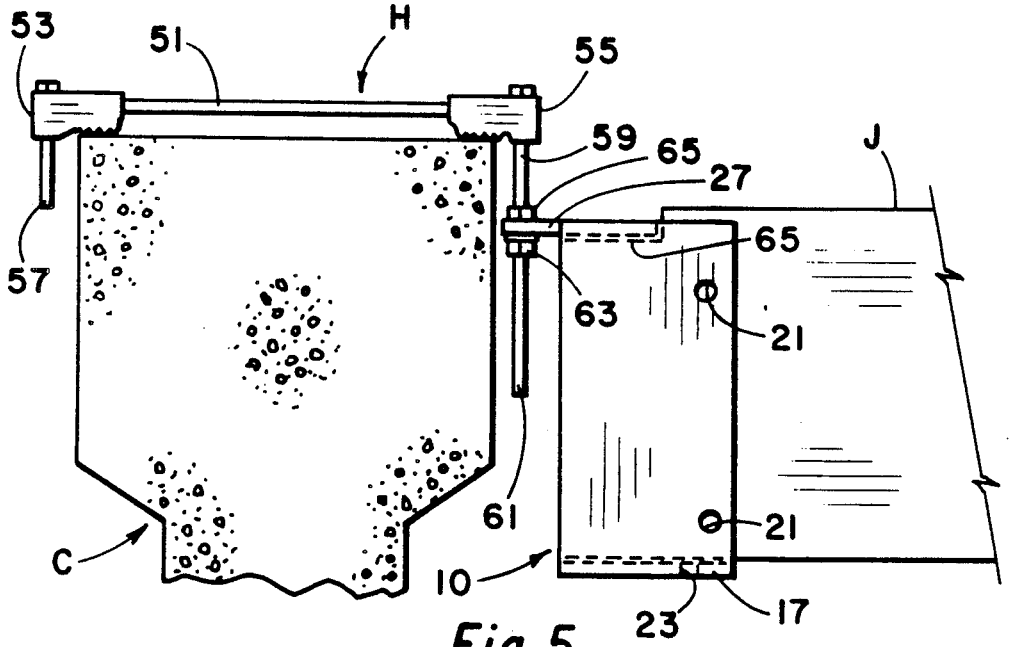
FIG. 5 is a side elevation view of the bracket of FIG. 1 supporting a joist from a concrete bridge column.

The width of the bottom plate 17 and the top plate 15, and therefore the width of the channel 19, is such that a joist J, shown in FIG. 5, can be inserted between the side plates 11 and 13. Preferably, the width is such that the joist J may be relatively easily inserted into the channel 19 but not so wide as to permit undesirable tipping of the joist J from side to side in the channel 19.

Preferably the side plates 11 and 13 will be provided with one or more transverse holes 21 through the rear portion of the plates 11 and 13 and the bottom plate 17 will be provided with at least one vertical hole 23 through its rear portion. These holes 21 and 23 are located to permit nails to be driven through the side plates 11 and 13 into the joist J to maintain the joist J in its appropriate position in the bracket 10.

As can best be seen in FIGS. 1 and 3, the top plate 15 extends from approximately the mid-point of the bracket 10 toward the forward edge 25 of the bracket 10 and includes a tongue 27 which extends beyond the forward edge 25 of the bracket 10. The tongue 27 has a mounting bolt hole 29 extending vertically therethrough.

The bracket 10 is typically formed by the welding of steel plates, though other materials and methods of assembly may be used as well. A typical steel bracket would use side plates 11 and 13 and a bottom plate 17 of $\frac{1}{8}$ to 3/16 inch in thickness and extending approximately four inches from the forward edge 25 to the rearward edge 31. The top plate 15 would typically be of $\frac{1}{4}$ inch to $\frac{3}{8}$ inch thick steel, approximately $3\frac{1}{2}$ inches long with $1\frac{3}{4}$ inches of that length included in the tongue 27. The interior cross section of the channel 19 would typically range from $1\frac{5}{8}$ to $1\frac{7}{8}$ inches in width by 7 inches to $7\frac{1}{4}$ inches in height. The above dimensions are applicable for steel brackets used in most bridge construction applications, but, in specific applications, all of those dimensions may be varied to achieve suitable strength characteristics.

Figure 4:
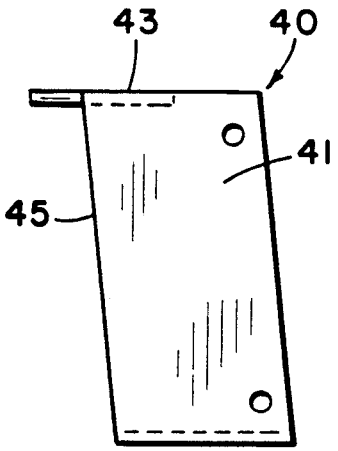
FIG. 4 is a side elevation view of another embodiment of the temporary bridge joist support bracket.

Turning to FIG. 4, a particularly preferred embodiment of the bracket is illustrated in which the side plates 41 take on the shape of a parallelogram having an upper forward corner 43 forming an acute angle greater than approximately 75°. The bracket 40 shown in FIG. 4 is in all other respects similar to the bracket shown in FIGS. 1, 2 and 3. The angular relationship of the forward edge 45 of this bracket 40 affords some added benefits in assembly and disassembly of the temporary bridge joist support system for reasons hereinafter explained.

Turning now to FIG. 5, the use of the bracket 10 in its bridge construction application is illustrated. A typical hanger assembly H is shown mounted across the top of a concrete column C. The hanger assembly H typically includes a steel rod 51 with U brackets 53 and 55 welded to its ends. The brackets 53 and 55 may include corrugated lower surfaces for firm engagement with the top of the column C. Bolts 57 and 59 extend vertically downwardly through the U-brackets 53 and 55. These hanger assemblies are presently available. When used with the temporary bridge joist support bracket 10, the threaded end 61 of the bolt 59 is slipped through the top of the mounting bolt hole 29 in the tongue 27 and a nut 63 threaded onto the bolt 59 so that the tongue 27 will rest on the nut 63 The nut 63 can therefore be adjusted to establish the desired height of the bracket 10 in relation to the top of the column C. A similar procedure is performed with respect to the opposite column of the bridge span (not shown). With brackets 10 mounted on each of the opposite columns C, a joist J cut to appropriate length is inserted into the brackets 10 and allowed to rest on the bottom plate 17 of the brackets 10. The weight of the joist J causes the bottom plates 17 to come into flush abutment with the bottom of the joist J. Thus, the joist J is held in a substantially rigid connection between the brackets 10 and the columns C. To insure the stability of this arrangement, nails (not shown) may be partly driven into the holes 21 and 23. It should be noted that, should the height of the joist J exceed the height of the interior cross-section of the bracket 10, the top end of the joist J can be notched 65 as shown to permit its full insertion into the bracket 10.

It should also be noted that a second nut 65 may be employed above the tongue 27 for convenience in manipulating the hanger assembly H and the connection of the bracket 10.

It should also be noted that use of the bracket 40 with its parallelogram side plates 41 allows added space between the column C and the bracket 40 in which to manipulate the bracket 40 so the joist J can be more easily mounted and dismounted from the assembly.

Thus, it is apparent that there has been provided, in accordance with the invention, a temporary bridge joist support bracket that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A bracket for suspending a joist at its ends from vertical bolts threaded to receive nuts on their lower ends and depending from hangers extending across two bridge columns to support poured concrete spanning the columns during drying comprising a pair of sideplates, a top plate and a bottom plate rigidly connected to form a channel of rectangular cross-section of width to receive one of said ends of said joist therebetween, said top plate extending from approximately the midpoint of said channel toward a forward edge of said channel and having a tongue extending horizontally forwardly of said forward channel edge, said tongue having a vertical hole for receiving a threaded end of one of said bolts therethrough with said tongue resting on one of said nuts.

2. A bracket according to claim 1, said side plates being rectangular.

3. A bracket according to claim 1, said side plates being parallelograms having acute upper forward corners greater than approximately 75 degrees.

4. A bracket according to claim 1, each of said side plates having at least one transverse hole therethrough.

5. A bracket according to claim 1, said bottom plate having at least one vertical hole therethrough.

6. A bracket according to claim 1, said side and bottom plates being $\frac{1}{8}''$ to 3/16″ steel and said top plate being $\frac{1}{4}''$ to $\frac{3}{8}''$ steel.

7. A bracket according to claim 6, said channel having interior cross-sectional width and height of $1\frac{5}{8}''$ to $1\frac{7}{8}''$ and 7″ to $7\frac{1}{4}''$, respectively.

8. A bracket according to claim 7, each of said side and bottom plates being approximately 4″ from forward to rear edges thereof.

9. A bracket according to claim 8, said top plate being approximately $3\frac{1}{2}''$ long including said tongue being approximately $1\frac{3}{4}''$ long.

10. A bracket according to claim 9, said side plates being parallelograms having acute upper forward corners greater than approximately 75 degrees.

11. A bracket according to claim 10, each of said side plates having at least one transverse hole therethrough.

12. A bracket according to claim 11, said bottom plate having at least one vertical hole therethrough.

13. For suspending a joist at its ends between two bridge columns to support poured concrete spanning the columns, the combination comprising:

a hangar;

a threaded bolt depending from said hangar and having a threaded lower end;

a nut for mounting on said threaded bolt ends; and a bracket having a pair of side plates, a top plate and a bottom plate rigidly connected to form a channel of rectangular cross section of width to receive one of said ends of said joist therebetween, said top plate extending from approximately the mid point of said channel toward a forward edge of said channel and having a tongue extending horizontally forwardly of said forward channel edge, said tongue having a vertical hole for receiving said threaded end of said bolt therethrough with said tongue resting on said nut.

* * * * *